United States Patent [19]

Rothal

[11] Patent Number: 4,827,738

[45] Date of Patent: May 9, 1989

[54] EAR ORNAMENT

[76] Inventor: Richard I. Rothal, 20505 E. Country Club Dr. #235, North Miami Beach, Fla. 33180

[21] Appl. No.: 777,272

[22] Filed: Sep. 18, 1985

[51] Int. Cl.[4] ..... A44C 7/00

[52] U.S. Cl. ..... 63/14.1; D11/42

[58] Field of Search ..... 63/14 R, 14 A, 14 G; D11/42

[56] References Cited

U.S. PATENT DOCUMENTS 2,409,369 10/1946 Lo Curto ..... 63/14 A 2,914,928 12/1959 Warden ..... 63/14 A

FOREIGN PATENT DOCUMENTS 205032 12/1955 Australia ..... 63/14 G 936058 7/1948 France ..... 63/14 A 7563 of 1911 United Kingdom ..... 63/14 A

*Primary Examiner*—Richard J. Johnson

[57] ABSTRACT

Ear ornamentation made easily attached by the layman to this invention creating a new alternative as to the positioning of ornamentation suspended about the ear. The invention itself has two compression coils in part with a formed wire.

2 Claims, 4 Drawing Sheets

EAR ORNAMENT

BACKGROUND OF THE INVENTION

Ear ornamentation, so popular and common amongst the fashion conscious people of today is usually attached to the earlobe by means of a post pushed through a perforation in the ear lobe with a retaining device attached to the protruding portion of the post behind the ear lobe, or by way of other devices which clamp on to the ear lobe.

The disadvantages associated with piercing and clamping devices are many with both piercing and clamping devices there is a great possibility that the ornament may be lost. In addition there must be a limit on the weight of the ornament to facilitate the wearer's comfort. Finally, clamping devices can cause great discomfort due to the pressure placed upon the ear lobe and piercing types possess a multitude of problems from the operation itself including infection, scaring and tearing of the lobe during installation, removal or if the device is pulled upon.

The means by which the ornament is attached to such a piercing or clamping device is predominantly via jump ring (a length of wire wound in a circular shape so as to join both ends at one common point, that is completing the circle). If not by jump ring the ornament is adhered directly to the post or clamp.

The process by which the jump ring is joined to the piercing or clamping device is tedious. Usually requiring special tools not common to the layman, thus ornamentation is available to the consumer as a set or complement parts including an ornament and an attached ear retaining device. If there is separation of the set due to damage of one part or another, or by the desire of the individual to join or combine a part of a particular set to another, a jeweler is usually needed.

Ear ornamentation in the past has usually been designed and manufactured to be worn on or directly below the ear lobe. This fact being partly due to the dictates of fashion and the availability or lack of availability of retained devices that would allow alternative positioning of an ornament about the ear.

Accordingly, it is seen that a need remains for extinguishing the aforementioned problems associated with the devices available for securing ornamentation to and around the ear. Therefore, it is to the provision of a solution to those problems that the present invention is primarily directed.

SUMMARY OF THE INVENTION

This invention as described by appearance consists of a wire formed to the natural configuration of the post auricle groove of the outer ear. At both ends of the formed wire or retaining wire extend a compression coil (spring type) wound in an upward direction on a vertical plain relative to the wire form and convoluted outward on a horizontal plain relative to the wire form. The outward convolution may be in either direction. The lower compression coil extends outward just in front of the lobule of the ear. The upper compression coil extends outward just in front of the upper helix of the ear.

The natural configuration of the wire about the back of the ear and the direction of the wound coil make for a comfortable and snug fit to the ear.

The invention may be manufactured of a length of wire of any suitable metal (precious or non-precious) or material that can be bent or molded into form.

In one form the invention is a device that allows the adaptation by the layman of an ornament via jump ring to be easily threaded onto one of two compression coils that extend from both ends of the ear retaining wire. An ornament via jump ring can be threaded onto one of the open ends of either compression coil by prying the open end of the compression coil out enought to place the jump ring between the open end and the compression band next to the open end. Then, by sliding the jump ring onto and around the bands of the coil until the jump ring sits firmly between two coil bands or until the jump ring resides around all bands that comprise the coil. The ornament via jump ring is now being securely held in place whether the jump ring is between two coil bands due to pressure of the coiled bands directed inward toward one another by the natural configuration of the coil squeezing and subsequently locking the jump ring into its placed position; or the jump ring resides around all coil bands moving freely along the circumference of the coil but unable to work its way off the coil without aiding forces.

In another form, the invention offers an alternative to the placement of ornamentation as worn on or around the ear. Commonly available ornament retaining devices are designed so as to have the ornament hang below or placed against the lobe of the ear. This invention allows for the ornamentation to be placed in front of the ear lobe, at both the bottom and top of the ear. Ornamentation can be worn with this invention solely or in conjunction or combination with ornamentation attached to common devices that are palced on or under the ear lobe.

In another form the invention allows for a heavier ornament(s) to be worn more comfortably than that of the more common devices that adhere to the ear lobe. The invention accomplishes this because the weight of the ornament(s) is distributed and supported by the stronger post auricle grove of the ear, thus leaving the ear lobe free from pressure and pull.

DETAILED DESCRIPTION

Figure 1:
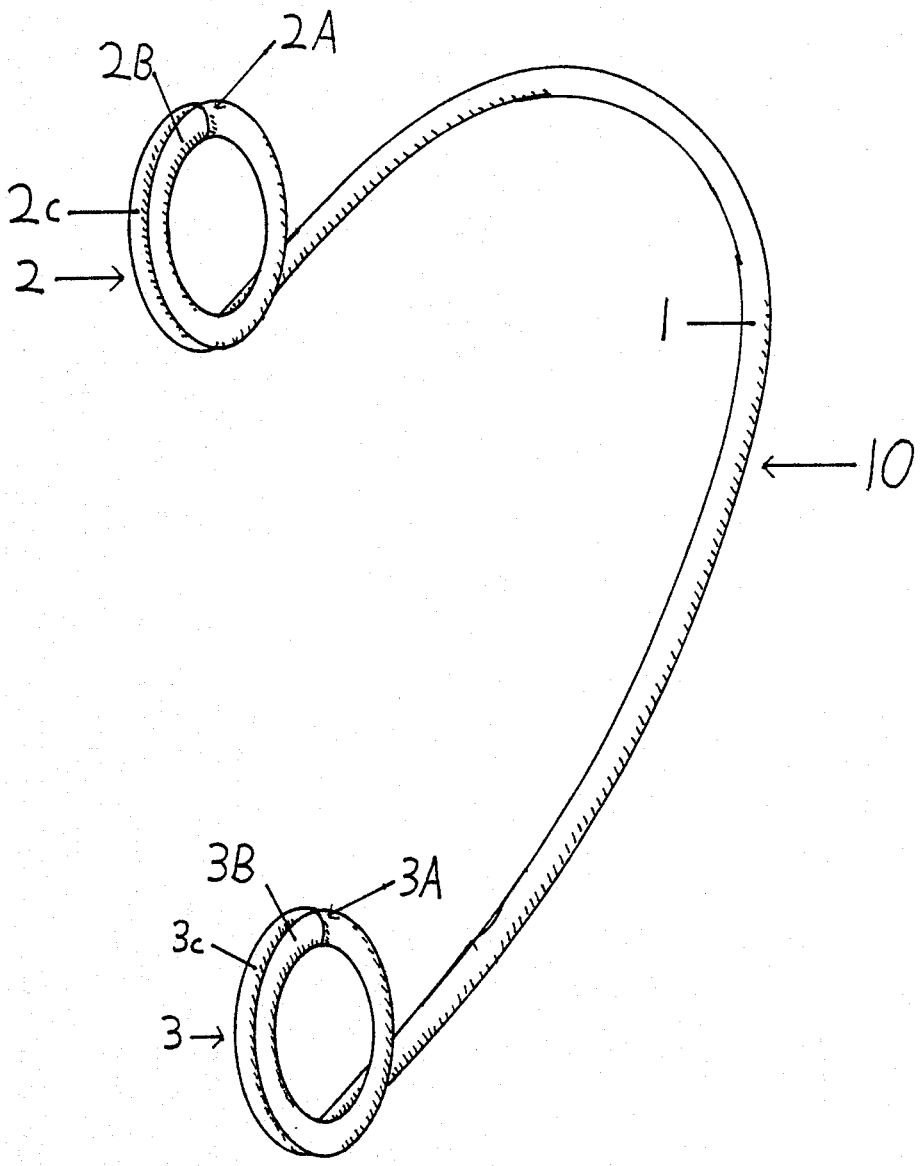
FIG. 1 is a perspective view of this invention.
Figure 4:
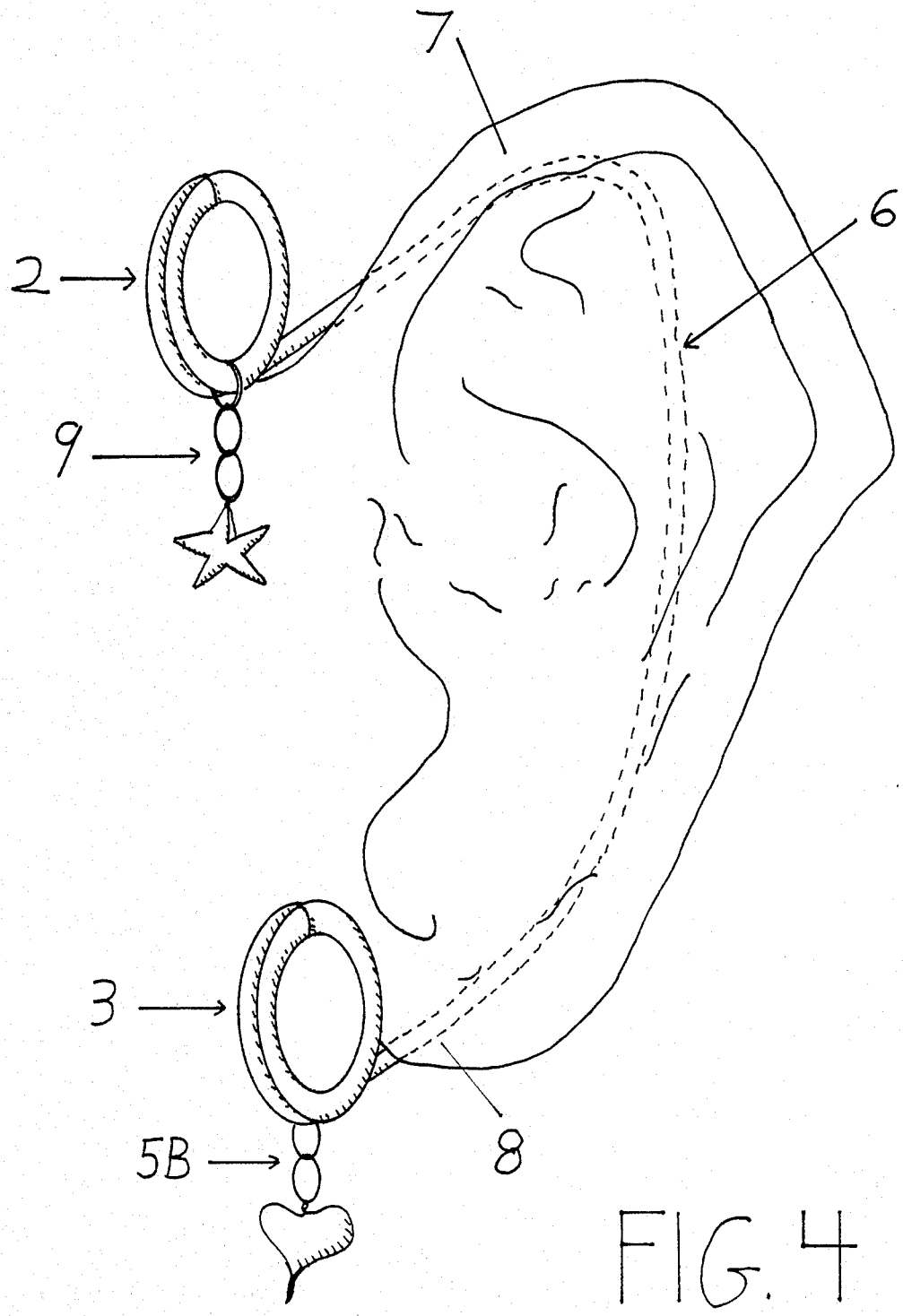
FIG. 4 is a perspective view of the invention as it is positioned on the ear.

With reference to the drawing there is shown in FIG. 1, a ear hanger 10 being comprised of a formed wire 1 contoured to the natural configuration of the post auricle groove 6 of the outer ear as shown in FIG. 4 at both ends of the formed wire 1 as in FIG. 1 extend a compression coil 2 and 3 (spring type) wound in an upward direction about an axis which extends generally perpendicular to a vertical plane relative to the formed wire 1. The coils are convoluted outward on an axis positioned in a horizontal plane relative to the plane of the formed wire 1. The outward convolution of the coil 2 and 3 may be in either direction.

The coils described as upper 2, and lower 3 relative to this invention's worn position on the ear. Both coils 2 and 3 comprise an open end 2A and 3A and two coil bands 2B and C and 3B and C.

Figure 2:
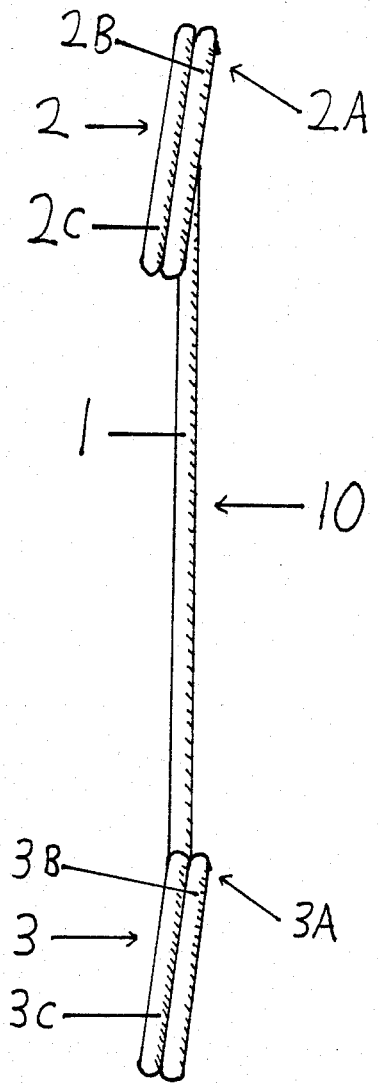
FIG. 2 is a perspective view of this invention of FIG. 1 rotated 60 about a vertical axis from the position of invention in FIG. 1.

FIG. 2 refers to the ear hanger 10 as viewed from the front as in its worn position.

Figure 3:
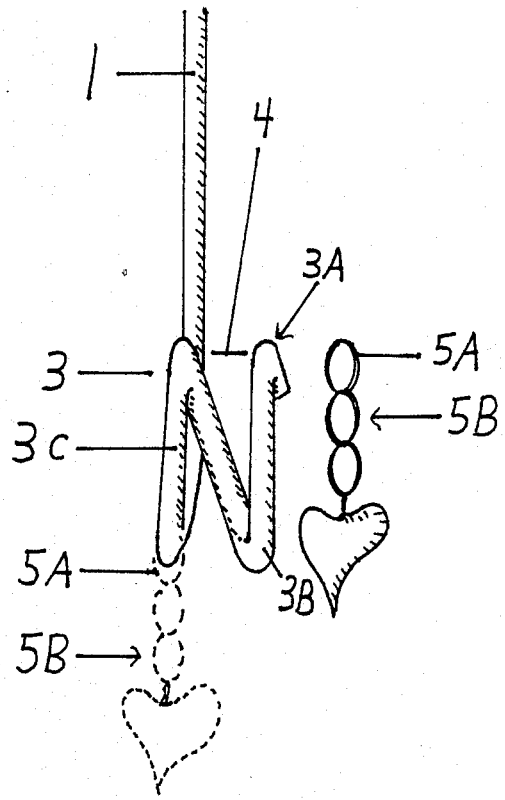
FIG. 3 is a fragmented view of the lower portion of this invention of FIG. 2. Illustrating the manipulation of said portion necessary to add an ornament via jump ring.

FIG. 3 illustrates a fragmented view of the lower portion of the ear hanger 10 and pointing out the lower compression coil 3 as viewed in FIG. 2, but as shall be manipulated to add an ornament 5B via jump ring 5A. The open end 3A and subsequently the first coil band 3B of the compression coil 3 must be spread apart as illustrated at 4 away from the second coil band 3C allowing the jump ring 5A to be placed onto and around the first coil band 3B and moved along the coil bands 3B and 3C until it is safely and securely resting around the second or inside coil band 3C as is the new placement of the ornament 5B and jump ring 5A shown in this FIG. 3 by dotted lines. A large jump ring may reside and encompass both coil bands 3B and 3C.

FIG. 4 is an illustration of the ear hanger 10 as positioned and worn on the ear. The formed wire 1 shown in dotted lines and not visible when the ear hanger is in position on the ear is designed to be and is supported by the post auricle groove 6. The upper compression coil 2 extends outward just in front of the upper helix 7 of the ear. This compression coil 2 illustrating an ornament 9 as such an ornament will hang on the ear hanger 10. The lower compression coil 3 extends outward just in front of the lobule 8 of the ear. This compression coil 3 illustrating an ornament 5B as such an ornament that was added to the ear hanger 10 in FIG. 3.

I claim:

1. A device adapted to be worn on the ear to allow the simple attachement of existing ornaments by means of jump rings or the like, said devices comprising a continuous length of wire forming a pair of compression coils, one at each of its ends, the portion intermediate the ends being generally in a plane and formed to the natural configuration of the post auricle groove of the outer ear of a wearer, said coils and intermediate portion being constructed and arranged to adapt the device to be fitted on the wearer's ear with one of said coils positioned forward of the upper helix, the other forward of the lobe, and the intermediate portion lying along the juncture between the ear and head; each of said coils comprising a winding about an axis which extends generally perpendicularly to the plane of said intermediate portion; each said coil including means whereby a jump ring or the like may be detachably attached thereto by being resiliently gripped by or simply linked to said coil.

2. The device of claim 1 wherein the windings in each coil are spaced apart.

* * * * *